US007360680B1

(12) United States Patent
Grossmeyer

(10) Patent No.: US 7,360,680 B1
(45) Date of Patent: Apr. 22, 2008

(54) MAILBOX ASSEMBLY AND A MAILBOX ASSEMBLY KIT

(76) Inventor: Charles John Grossmeyer, 218 Pleasantview, Grand Blanc, MI (US) 48439

( * ) Notice: Subject to any disclaimer, the term of this patent is extended or adjusted under 35 U.S.C. 154(b) by 0 days.

(21) Appl. No.: 11/393,181

(22) Filed: Mar. 31, 2006

(51) Int. Cl.
*B65G 11/04* (2006.01)

(52) U.S. Cl. ..... 232/45; 232/34; 340/569

(58) Field of Classification Search ..... 232/45, 232/44, 17, 47, 34–36; 340/569
See application file for complete search history.

(56) References Cited

U.S. PATENT DOCUMENTS

| | | | | | |
|---|---|---|---|---|---|
| 1,026,338 | A * | 5/1912 | Bailey | 232/35 |
| 2,604,260 | A * | 7/1952 | Brown | 232/19 |
| 2,860,830 | A * | 11/1958 | Mrenza | 232/17 |
| 3,611,333 | A * | 10/1971 | Conigliaro | 340/539.14 |
| 3,735,919 | A * | 5/1973 | Morgan | 232/17 |
| 3,802,619 | A | 4/1974 | Leigh et al. | |
| 3,880,344 | A | 4/1975 | Earle | |
| 4,101,877 | A * | 7/1978 | Rush | 340/569 |
| 4,724,999 | A | 2/1988 | Fitzgerald et al. | |
| 4,805,834 | A * | 2/1989 | Saba | 232/34 |
| 4,844,332 | A | 7/1989 | Long | |
| 4,858,823 | A * | 8/1989 | Fischer | 232/34 |
| 4,905,891 | A | 3/1990 | Wildish et al. | |
| 4,993,626 | A | 2/1991 | Berry | |
| 5,000,378 | A | 3/1991 | Dorr et al. | |
| 5,056,711 | A * | 10/1991 | Bush | 232/17 |
| 5,096,115 | A | 3/1992 | Hassan | |
| 5,143,284 | A | 9/1992 | Socarras | |
| 5,239,305 | A * | 8/1993 | Murphy et al. | 340/539.1 |
| D354,610 | S | 1/1995 | Hassan | |
| 5,400,959 | A * | 3/1995 | Cone | 232/39 |
| 5,435,484 | A | 7/1995 | Carlson | |
| 5,526,979 | A | 6/1996 | Mann | |
| 5,645,215 | A | 7/1997 | Marendt et al. | |
| 5,938,113 | A | 8/1999 | Kim | |
| 5,950,919 | A * | 9/1999 | Adams | 232/34 |
| 5,979,751 | A | 11/1999 | Maddox | |
| 6,234,388 | B1 | 5/2001 | Taylor | |
| 6,244,505 | B1 * | 6/2001 | Grimes et al. | 232/47 |
| 6,299,061 | B1 | 10/2001 | Henson | |
| 6,375,071 | B1 * | 4/2002 | Kim | 232/47 |
| 6,533,167 | B2 | 3/2003 | Hassan | |
| 6,655,577 | B2 * | 12/2003 | Mihaylov et al. | 232/45 |
| 6,719,195 | B2 * | 4/2004 | Farentinos | 232/45 |
| 6,722,561 | B1 * | 4/2004 | Thomas et al. | 232/39 |
| 6,736,310 | B1 * | 5/2004 | Mesol | 232/39 |

(Continued)

FOREIGN PATENT DOCUMENTS

| | | |
|---|---|---|
| AU | A 64716/94 | 12/1994 |

(Continued)

*Primary Examiner*—William L. Miller
(74) *Attorney, Agent, or Firm*—Law Offices of John Chupa & and Associates, P.C.

(57) ABSTRACT

A mailbox kit 10 which may be utilized to selectively create several different types of mailbox assemblies, such as an assembly which may be selectively locked and which may be selectively accessed from several different directions. In one non-limiting embodiment, the created mail box configuration may be closely, and operatively stacked in an overall aesthetically pleasing manner and provide remote notification functionality upon receipt of a letter and/or other item.

4 Claims, 4 Drawing Sheets

U.S. PATENT DOCUMENTS

| | | | | |
|---|---|---|---|---|
| 6,831,558 | B1 * | 12/2004 | Andrew | 340/539.2 |
| 6,840,438 | B2 | 1/2005 | Hassan | |
| 2003/0150906 | A1 | 8/2003 | Long | |
| 2004/0195304 | A1 | 10/2004 | Kujawa et al. | |
| 2004/0238615 | A1 | 12/2004 | Offenbacher | |
| 2006/0144918 | A1 * | 7/2006 | Hutchinson | 232/35 |

FOREIGN PATENT DOCUMENTS

| | | |
|---|---|---|
| WO | WO 97/43935 | 11/1997 |

* cited by examiner

MAILBOX ASSEMBLY AND A MAILBOX ASSEMBLY KIT

FIELD OF THE INVENTION

The present invention generally relates to a mailbox assembly and to a mailbox assembly kit and more particularly, to a new and improved mailbox assembly which may be selectively and operatively deployed in a relatively narrow space and which may be easily accessed, and to a kit which allows a mailbox assembly to be easily created and easily configured in one of several alternate configurations which may be selectively configured by a user.

BACKGROUND OF THE INVENTION

A mailbox is used to selectively receive mail and/or other items and provides a convenient and fixed location for the reception of such material. Further and typically, a conventional or "currently used" mailbox includes a selectively movable flag which is generally disposed on the side of the mailbox and which is selectively movable from a first lowered position to a second raised position when mail or other items are placed within the mailbox for pickup by the postal employee. While prior mailboxes do selectively receive mail and/or other items, they do suffer from some drawbacks.

By way of example and without limitation, the selectively and movably disposed flag prevents these conventional mailboxes from being operatively placed in a narrow space or to be closely (e.g., abuttingly) and operatively "stacked together" (e.g., along a horizontal axis parallel to the ground along which these mailboxes respectively reside), thereby preventing space from being efficiently used and conserved and limiting the number of such mailboxes which may be used within a certain area or space. Oftentimes, the flags are removed in order to allow the mailboxes to be efficiently "stacked" or positioned, thereby creating an overall unaesthetically pleasing appearance and causing structural damage to these mailboxes, while disallowing their full functionality.

Further, oftentimes the owner or user of a mailbox must travel a relatively long distance, often in undesirable weather conditions, to determine whether mail has been picked up by the postal employee or is actually placed within the mailbox (e.g., the user does not see mail being deposited and/or is unaware of the exact mail delivery time). Hence, often a user or owner of a mailbox must traverse to the mailbox on several separate occasions before obtaining the mail or other items which are deposited within the mailbox (i.e., since the user does not typically know beforehand whether the mailbox actually contains items), thereby increasing the overall inefficiency of the mail delivery process and increasing the inconvenience of the process for the recipient of the mailed items.

Further, many of the conventional mailboxes are not adapted to be readily locked, thereby allowing the deposited and mailed items to be easily obtained by a thief and increasing the likelihood that the identity of the person to whom the unlawfully obtained mail was sent will be misused by the thief. Moreover, the mailboxes which are selectively locked are not readily modifiable or designed to be readily adapted to be used only in an "unlock" configuration, thereby limiting their usefulness only to group of owners and users seeking a locking type mailbox.

Yet further, the conventional mailboxes typically only allow the deposited material to be accessed through a single entry door or member, thereby restricting the use of the mailbox to a single type of placement configuration (e.g., to a placement configuration in which the single entry door is readily accessible to the user and/or owner). Thus, based upon the foregoing, the conventional mailboxes are not readily and selectively configurable or adaptable to address a wide range of consumer (e.g. user) and mounting needs and requirements.

The present invention overcomes these and other drawbacks and disadvantages of conventional mailboxes in a new and useful manner which is more fully delineated below.

SUMMARY OF THE INVENTION

It is a first non-limiting object of the present invention to provide a mailbox which overcomes some or all of the previously delineated disadvantages of prior mailboxes.

It is a second non-limiting object of the present invention to provide a mailbox which overcomes some or all of the previously delineated disadvantages of prior mailboxes and which, by way of example and without limitation, includes at least two separate access doors.

It is a third non-limiting object of the present invention to provide a mailbox assembly which overcomes some or all of the previously delineated disadvantages of prior mailboxes and mailbox assemblies and which, by way of example and without limitation, may be selectively configured in a plurality of configurations.

It is a fourth non-limiting object of the present invention to provide a mailbox assembly which overcomes some or all of the previously delineated disadvantages of prior mailboxes and mailbox assemblies and which, by way of example and without limitation, communicates to a remotely placed assembly the presence of deposited items.

It is a fifth non-limiting object of the present invention to provide a mailbox assembly which overcomes some or all of the previously delineated disadvantages of prior mailbox assemblies and which, by way of example and without limitation, includes a selectively movable flag, which is selectively inserted into a reception slot which is operatively disposed upon the mailbox assembly.

It is a sixth non-limiting object of the present invention to provide a mailbox assembly which overcomes some or all of the previously delineated disadvantages of prior mailbox assembly and which, by way of example and without limitation, allows outgoing mail to be situated so that it may easily be retrieved by an individual depositing incoming mail.

According to a first non-limiting aspect of the present invention, a mailbox assembly is provided and includes a generally hollow body having a pair of opposed open ends and a flag reception slot; a first door portion which is movably disposed upon the generally hollow body and which is movable from a first position remote from a first of the pair of opposed open ends to a second position in which the first door portion covers the first of the pair of opposed open ends; a second door portion which is movably disposed upon the generally hollow body and which is movable from a first position remote from a second of the pair of opposed open ends to a second position in which the second door portion covers the second of the opposed open ends; and a flag which is movably disposed upon the generally hollow body and which is movable from a first position which is remote from the flag reception slot to a second position in which the flag is wholly resident within the flag reception slot.

According to a second aspect of the present invention, a mailbox assembly is provided and includes a generally hollow body having an open end which selectively allows communication into the generally hollow body; and a door which is movably disposed upon the generally hollow body and which is selectively movable from a first position in which the door covers the open end and prevents communication from occurring with the generally hollow body to a second position which is remote from the open end and which allows communication to occur with the generally hollow body and wherein the door includes an interior surface which resides within the generally hollow body when the door is moved to the first position and includes a mail reception slot.

According to a third aspect of the present invention, a mailbox assembly kit is provided and includes a generally hollow body portion including a pair of substantially identical doors which are respectively and movably disposed upon the body portion, each of the doors including a respective opening; a first lock assembly which is adapted to be selectively and operatively inserted into the respective opening of a first of the pair of doors; a second lock assembly which is adapted to be selectively and operatively inserted into the respective opening of a second of the pair of doors; a first handle which is adapted to be selectively and operatively placed into the respective opening of the first of the pair of doors only when the first lock assembly is remote from the respective opening of the first of the pair of doors; and a second handle which is adapted to be selectively and operatively placed into the respective opening of the second of said pair of doors only when the second lock assembly is remote from the respective opening of the second of the pair of doors.

These and other features, aspects, and advantages of the present invention will become apparent from a consideration of the following detailed description of the preferred embodiment of the invention, including the subjoined claims, and by reference to the following drawings.

DETAILED DESCRIPTION OF THE PREFERRED EMBODIMENT OF THE INVENTION

Figure 1:
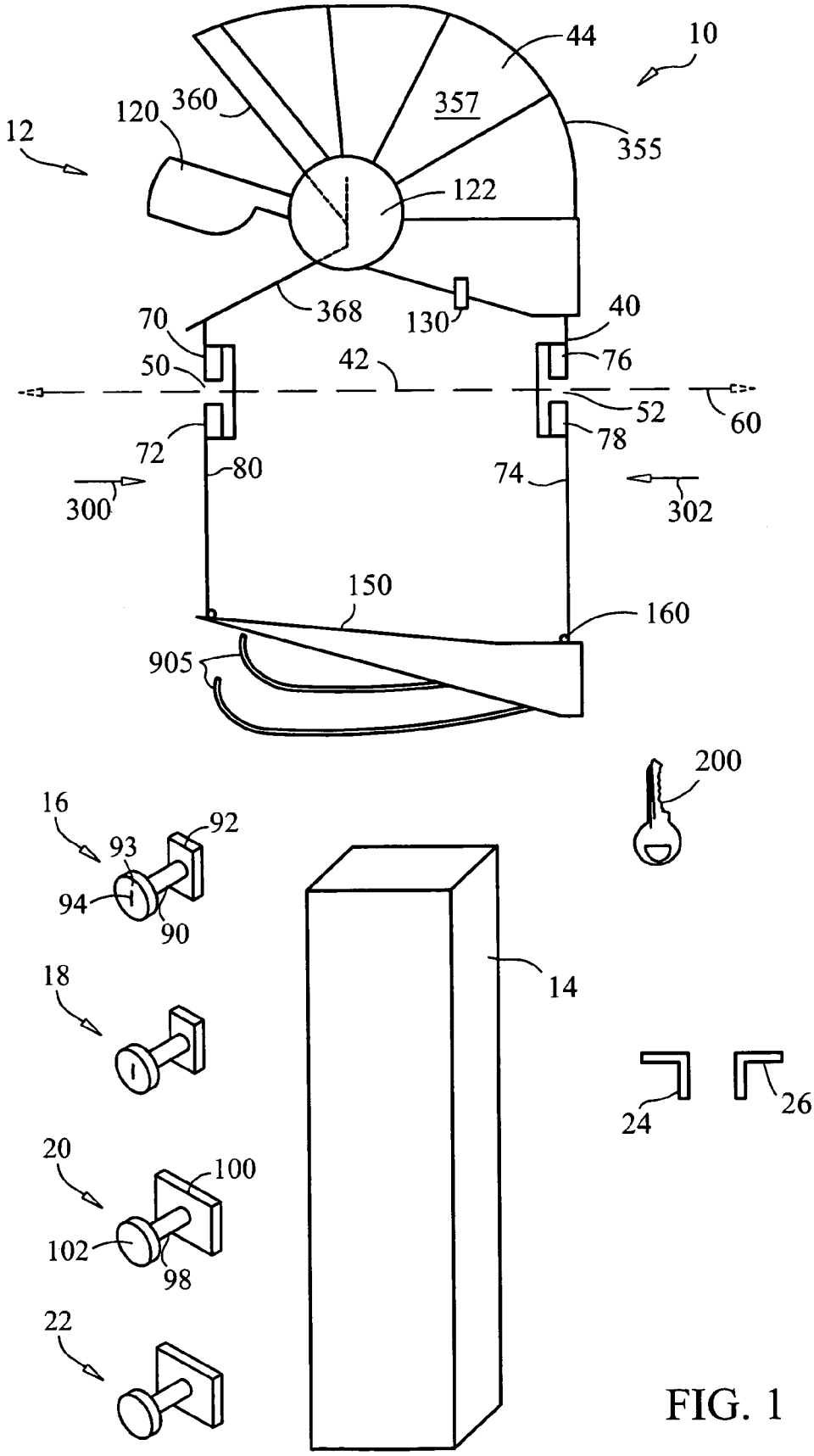
FIG. 1 is a perspective and unassembled view of a mailbox assembly kit which is made in accordance with the teachings of the preferred embodiment of the invention.

Referring now to FIG. 1, there is shown a mailbox assembly kit 10 which is made in accordance with the teachings of the preferred embodiment of the invention. It should be appreciated that the terms "mailbox assembly" and "mailbox" may be interchangeably utilized throughout this description and that each of these terms, as later used in this description, refers to the cooperative and selective combination of all or a portion of the items which are shown and which will be described within the mailbox kit assembly 10 and which cooperatively allow for the selective receipt and storage of a letter and/or other items and/or material in a selectively configurable assembly.

Particularly, the mailbox kit 10, in one non-limiting embodiment of the invention, includes a mail box body portion 12, a post 14, a pair of substantially identical locks 16, 18, and a pair of substantially identical handles 20, 22. The mailbox kit 10 may further include a pair of substantially identical mounting brackets 24, 26. In another non-limiting embodiment, the post 14 is not provided with the kit 10 and in other non-limiting embodiments a variety of different shaped posts may be provided within the kit assembly 10 and a variety of dissimilarly shaped brackets 24, 26 may also be provided in a alternate embodiments.

The mail box body portion 12 may be of substantially any desired shape and size and, in this one non-limiting embodiment of the invention, the mail box body is generally "hood shaped" and has a substantially hollow first body portion 40 having a generally rectangular shape and cross-sectional area and defining an internal cavity 42, and a second "L-shaped" or arcuate top "hood" portion 44 which, in one non-limiting embodiment of the invention, integrally or selectively (e.g., removably and abuttingly) terminates or is applied onto or into the portion 40. It should be appreciated that portion 44 may be hollow, thereby selectively extending the generally hollow interior cavity 42 when the member 44 rests upon member 40, or portion 44 may be substantially solid. The mail box body portion 12 may be manufactured from plastic, metal, and/or from substantially any other commercially available material and/or any other commercially available composite material.

Further, the mail box body 12 (e.g., portion 40) has four side walls 74, 75, 77, 80 and a bottom wall portion 150 which cooperatively form cavity 42. The body 12 includes first and second substantially identical and opposed recesses 50, 52 which, in one non-limiting embodiment, are substantially circular and which are axially aligned along axis 60 which, in one non-limiting embodiment of the invention, passes through the middle of walls 74, 80 (e.g., walls 74, 80 respectively have recesses 52, 50). Further, the opening 50 is bounded by two substantially identical flanges or protuberances 70, 72 which are operatively formed within wall 80, and the opening 52 is bounded by substantially identical protuberances of flanges 76, 78 which are operatively deployed and formed within the wall 74. In one non-limiting embodiment of the invention, the flanges 76, 78 are each substantially identical to the flanges 70, 72 and each of the deployed flanges 70, 72, 76, and 78 are substantially rectangular in shape. Additionally, in the most preferred embodiment of the invention, the arcuate top portion 44 further includes a stationary wall portion 355 and an opposed and selectively moveable and/or articuable door flap 360 which is operatively and selectively and pivotally coupled to an edge 368 of the wall portion 44 by pin 47 and which is operatively movable from a first open position in which the door flap 360 is remote from the arcuate portion 44 to a second closed position. In this non-limiting embodiment, the door flap 360 includes a handle member 385 which is substantially arcuate and allows the door flap 360 to be easily and selectively moved toward and away from the portion 44. Wall 355 terminates into or is coupled to the arcuate body portion 357.

As shown best in FIG. 1, the locks 16, 18 respectively have a first generally round body portion 90 which orthogonally terminates into a generally flat and generally narrow and rectangularly shaped portion 92. Each body portion 90 includes a generally round and/or generally bulbous and flared end 93 having a key reception opening 94. In one non-limiting embodiment of the invention, each end 93 includes a key reception tumbler which communicates with and/or which forms the opening 94 and is of the substantially same shape but is slightly larger than the openings 50, 52.

In one non-limiting embodiment of the invention, each handle 20, 22 is respectively "T" shaped and respectively includes a first portion 98 which orthogonally terminates into a second and generally rectangularly shaped portion 100. Each portion 98 includes a generally flared and rounded (e.g., generally bulbous) end 102 and, in one non-limiting embodiment of the invention, each end 102 is of substantially the same shape, but slightly larger than the openings 50, 52.

Further, in one non-limiting embodiment of the invention, the portion 44 (arcuate body portion 357) includes a slot 110 and a flag 120 which is pivotally and movably attached to the portion 40 by the use of pin or connecting member 122. Particularly, the flag 120 is selectively movable from a first position in which the flag 120 wholly resides within the slot 110 and is substantially hidden from view to those in the vicinity of the mail box assembly 10, to a second operative position in which the flag 120 is removed from the slot 110 (as shown best in FIG. 1).

Further, in one embodiment of the invention, the portion 44 is selectively removable from the portion 40, thereby allowing selective access to the cavity 42 and the portion 40 may be selectively secured to the portion 44 by the use of a welded joint or connection, by the use of screws, pins, adhesives, or substantially similar connecting members or other types of connecting strategy or technique. Further, in one non-limiting embodiment of the invention, each opposed wall 74, 80 is respectively and pivotally attached to the floor portion or member 150 of the portion 40 by the use of at least one respective pin, such as the pin 160 and each wall 74, 80 is made to frictionally engage the portion 44, thereby being respectively movable from a first position (shown in FIG. 1) in which the wall members 74, 80 cover or close the cavity 42 (best shown in FIG. 1), to a second or "open" position, in which the walls 74, 80 are made to extend away from the cavity 42 into a selective and "open" position. In this manner, the wall members 74, 80 may alternatively comprise selectively movable doors. Walls 75, 77 are stationarilly coupled to wall 150 and frictionally abut the walls 74, 80.

In one non-limiting embodiment of the invention, the mail box kit 10 is provided, as shown in FIG. 1, but with the portion 44 selectively removed from portion 42, and with a key 200 which is made to "lockably fit" within the openings 94 in a manner which is more fully discussed below.

Upon acquiring the mail box kit 10, a user and/or owner of the mail box kit assembly 10 initially determines whether one or both of the selectively movable doors, comprised of wall members 74, 80, are to be utilized in a respective "unlockable" manner. In the event that each of the doors 74, 80 are be utilized in an "unlockable" manner, the portion 98 of a first of the handle members 20, 22 is forcibly inserted into one of the openings 50, 52 while the portion 98 of a second of the handle members 20, 22 is forcible inserted into a second one of the openings 50, 52. In this manner, a user and/or owner of the assembly 10 utilizes the operatively deployed handles 20, 22 to selectively open and close the doors 74, 80 and these doors 74, 80 are not adapted to be selectively locked.

If a door 74, 80 is desired to be selectively lockable, that door 74, 80 is made to frictionally but selectively movably and/or rotatably receive, through the respective opening 50, 52, a respective portion 93 of one of the members 16, 18, such that the portion 92 of the received member 16, 18 resides within the cavity 42. To lock the door, such as doors 74, 80, the deployed lock, such as locks 16, 18, is turned so that the portion 93 abuts flange pairs, such as 70, 72 and 76, 78 which are deployed within that lock, and the key 200 is removed, thereby preventing the door from being opened. If it is desired to unlock the deployed lock, such as locks 16, 18, the key 200 is inserted into the deployed lock, such as lock 16, 18, and turned until portion 93 is rotated in a non-abutting arrangement with the flange pairs, such as pairs 70, 72 and 76, 78, thereby allowing the doors 74, 80 to open.

It should be realized that the key 200 may be selectively inserted into an opening 94 of a member 16, 18 and move the portion 93 of the member 16, 18 from a first position in which the portion 93 abuts a unique pair of the flanges 70, 72; and 76, 78, thereby substantially preventing the door 74, 80 upon which the member 16, 18 is operatively deployed to be opened when the key 200 is removed from the opening 94. The key 200 may also be selectively inserted into the opening 94 and move the same portion 93 into a position in which the portion 93 is remote from (e.g., does mot abut or engage) the unique pair of flanges 70, 72, 76, 78, thereby allowing the same door 74, 80 to be placed in an open position and thereby allowing selective access to the cavity 42.

Figure 3:
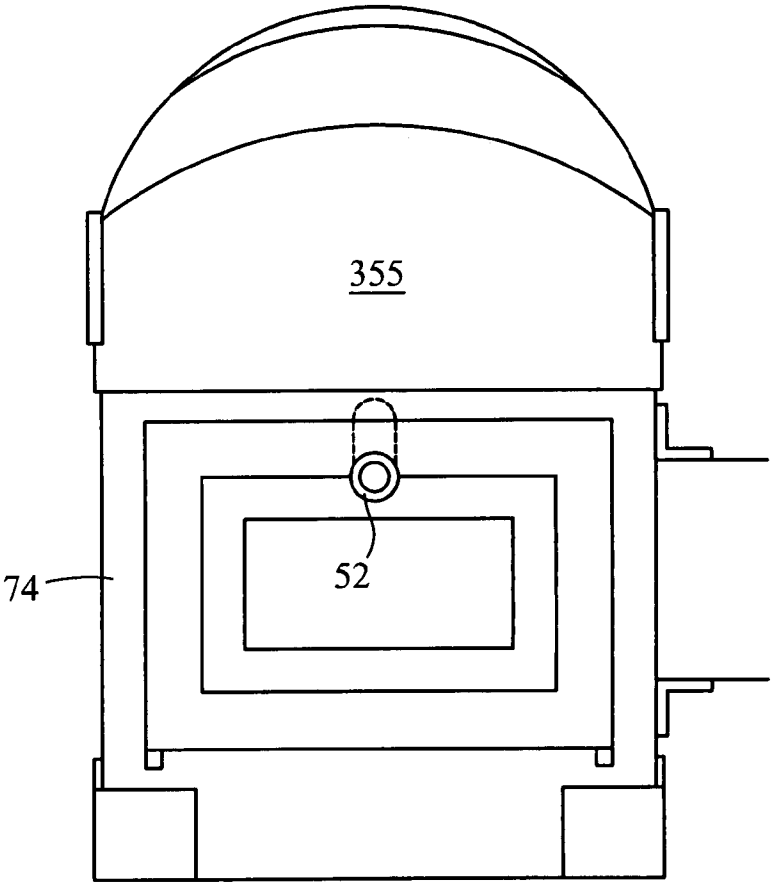
FIG. 3 is a back view of the mail box portion of the mailbox assembly which is shown in FIG. 1 and which is shown in a selectively assembled configuration.
Figure 2:
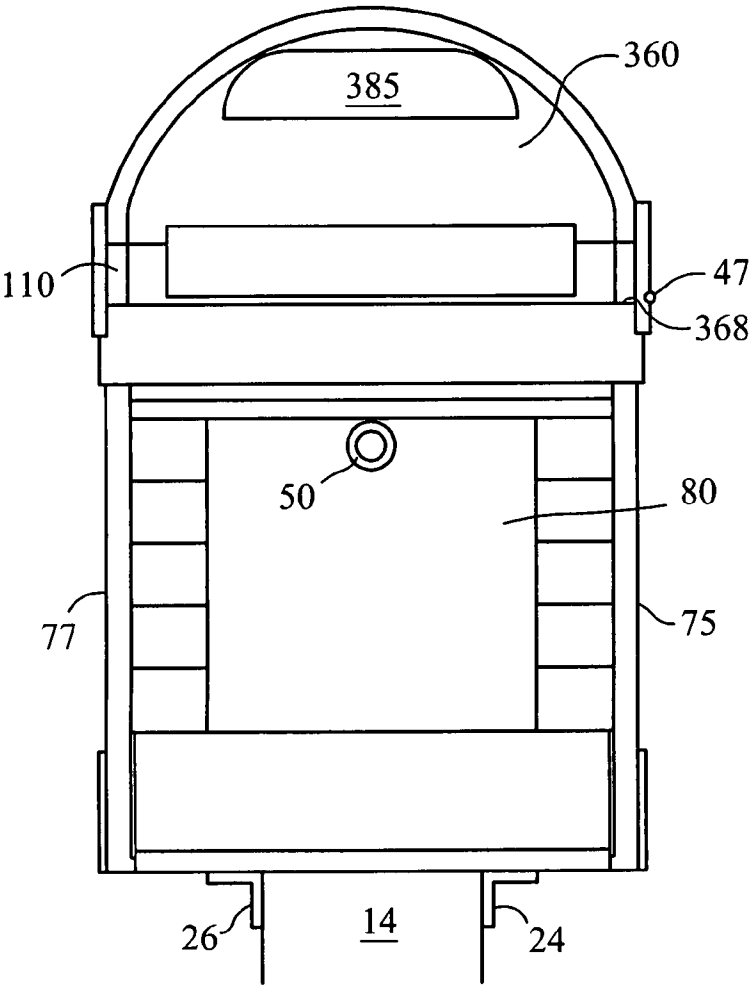
FIG. 2 is a front view of the mail box portion of the mailbox assembly kit which is shown in FIG. 1 and which is shown in a selectively assembled configuration.

Once the members 16, 18, 20, 22 are operably deployed upon/within the portion 40, the portion 44 is made to "fit" upon and to be connected to the portion 40 (i.e., by use of at least one connecting type or pin member 130). The assembled mailbox is then either placed upon a structure (e.g., a house) or deployed upon the stake 14 which is placed into the ground. Particularly, if the stake and/or post 14 is utilized, the brackets 24, 26 are initially and respectively coupled to the portion 40 and to the stake 14, as best shown in FIGS. 2 and 3, thereby coupling the body portion 12 to the post and/or stake 14.

Thus, it should be apparent that access (i.e., the user retrieving mail and/or other items which are resident within the cavity 42) may be achieved from both the front direction 300 and the back or rear direction 302 of the mailbox assembly 10, thereby increasing the overall utility of the mailbox assembly 10 and allowing the mailbox assembly 10 to be selectively and operatively deployed in a wide variety of locations. It should also be apparent that the selectively movable door flap 360 allows mail to be delivered (i.e., a postal employee may deposit mail through the door flap 360) without allowing access to any mail or other items which are resident within the cavity 42. Further, the slot 110 allows the flag 120 to easily and selectively deployed within the slot 110 and hidden from view, therefore increasing the overall aesthetic appearance and utility of the mailbox assembly 10 and allowing respective portions 42 of adjacent mailbox assemblies 10 to abuttingly and operatively engage, thereby allowing several mailbox assemblies 10 to be operatively deployed even in "tight" or closely confined areas, and to be mounted within a pillar.

Figure 4:
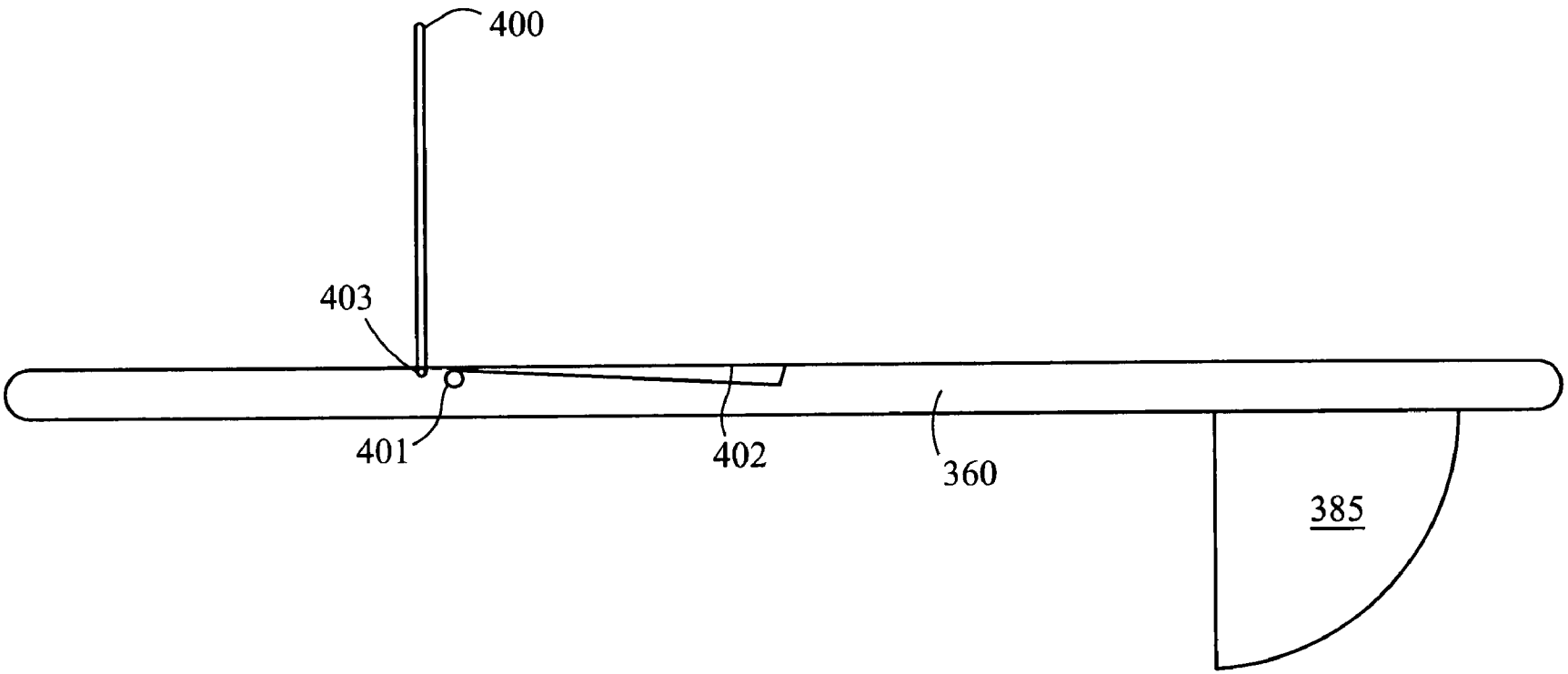
FIG. 4 is a side view of the mail delivery door of the mailbox assembly which is also shown in FIG. 2.
Figure 5:
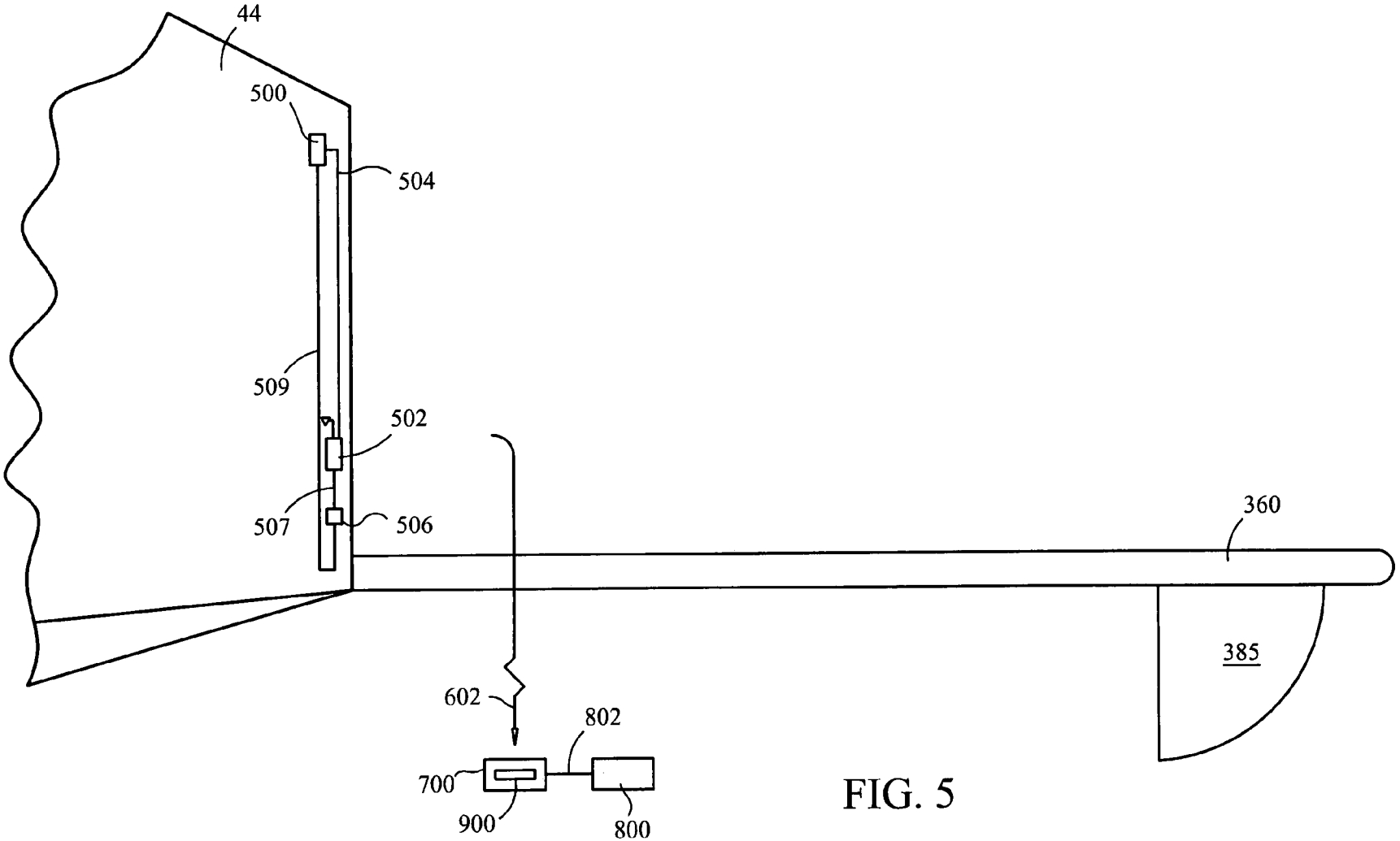
FIG. 5 is a side view of the door which is shown in FIG. 4 and which is made in accordance with the teachings of an alternate embodiment of the invention.

As best shown in FIG. 4, in the most preferred embodiment of the invention, the door flap or portion 360 includes a slot 402 into which the mail or other articles may be selectively deposited, thereby enabling a postal employee and/or other individual to retrieve the mail and/or other articles without accessing the cavity 42. In another non-limiting embodiment, the slot 402 is replaced by a flat member 400 which is pivotally coupled to the wall members 74, 80 by use of at least one respective pin, such as pin 403 and which may be selectively moved from a first open position, remote from door flap 360, to a second closed position in which the member 400 fully contacts the portion 360, thereby being adapted to secure mail or other materials upon the portion 360 and allowing these retained materials to be later removed.

In another non-limiting embodiment of the invention, the surface 355 includes at least one microwave or other type of proximity and/or motion sensor 500 which is physically and communicatively coupled to a transceiver 502 by the use of bus 504. A battery or other source of electrical power 506 is physically and communicatively coupled to the transceiver 502 and sensor 500, by use of the respective busses 507, 509. One non-limiting example of such a sensor is a sensor which is conventionally found in an automobile alarm system. In another non-limiting embodiment of the invention, a touch-sensitive sensor is used.

In operation, when mail and/or other items are deposited through the door flap 360, the at least one sensor 500 detects the presence and/or passage of a letter and/or other item and communicates the detection, by use of signal which it creates and places on the bus 504, to the transceiver 502. Upon receipt of this detection signal, the transceiver 502 creates a signal 602 which is transmitted to a remote transceiver 700, which is operatively coupled to a source of electrical power 800 by the use of bus 802 allowing this signal to be monitored and annunciated via but not limited to computerized automation, or status indicators such as an energizable light 900 to which the transceiver 700 sources power from the source 800 upon receipt of the signal 602. In this manner, a user and/or owner of the mailbox assembly 10 is notified that the mail or item resides within the assembly. The sensors 500, transceivers 502, power sources 508, and transceivers 700 and power sources 800 may be provided within the kit 10. In a alternative non-limiting embodiment, the signal may cause a momentary annunciation or a static annunciation which must be "cleared" by a later movement of any portion of the mailbox assembly 10 (e.g., a later opening and closing of the doors 50, 52). Which may be sensed by another sensor (not shown) which communicates the sensed information to the remote transceiver 700.

It is to be understood that the invention is not limited to the exact embodiments which have been delineated above, but that various changes and modifications may be made without departing from the spirit and the scope of the inventions as is further delineated in the subjoined claims. It should be appreciated that the provided mailbox assembly kit 10 allows for a wide variety of mailboxes to be created which are aesthetically pleasing, capable of being closely and operatively stacked, and capable of remotely notifying a user and/or owner of the placement of the mail or other items within the mailbox. Additionally, it should be appreciated that a user may configure the mailbox in any desirable way, including but not limited to using the mailbox in a secure and/or non-secure mode, and mounting the mailbox in a plurality of ways and/or configurations. Further, in another non-limiting embodiment, a newspaper holder 905 may be provided as part of the portion 40 and the bottom wall portion 150 may be angled.

What is claimed is:

1. A mailbox assembly kit comprising a generally hollow body portion including a pair of substantially identical doors which are respectively and movably disposed upon said body portion, each of said doors including a respective opening; a first lock assembly which is adapted to be selectively and operatively inserted into said respective opening of a first of said pair of doors; a second lock assembly which is adapted to be selectively and operatively inserted into said respective opening of a second of said pair of doors; a first handle which is adapted to be selectively and operatively placed into said respective opening of said first of said pair of doors only when said first lock assembly is remote from said respective opening of said first of said pair of doors; and a second handle which is adapted to be selectively and operatively placed into said respective opening of said second of said pair of doors only when said second lock assembly is remote from said respective opening of said second of said pair of doors.

2. The mailbox assembly of claim 1 wherein said generally hollow body includes a generally rectangular bottom portion and a generally semi-circular portion which resides upon said generally rectangular bottom portion.

3. The mailbox assembly of claim 1 wherein said generally hollow body includes a newspaper reception portion.

4. The mailbox assembly of claim 3 wherein said assembly further comprises a mail recognition portion which is deployed within said generally hollow body and which includes a communication portion, and a receiver which is in communication with said communication portion of said mail recognition portion and which is deployed remote from said generally hollow body, a signal is then cleared by opening and closing said first of said pair of doors or said second of said pair of doors of said mailbox assembly, whereby said communication portion sends a signal to said receiver.

* * * * *